United States Patent [19]

Adamski

[11] 3,986,072

[45] Oct. 12, 1976

[54] COLOR CATHODE RAY TUBE HAVING AN IMPROVED SHADOW MASK SUSPENSION SYSTEM

[75] Inventor: Alfred Adamski, Elmhurst, Ill.

[73] Assignee: Zenith Radio Corporation, Chicago, Ill.

[22] Filed: Aug. 12, 1975

[21] Appl. No.: 603,984

[52] U.S. Cl. ..... 313/404; 313/407

[51] Int. Cl.[2] ..... H01J 29/02; H01J 29/07

[58] Field of Search ..... 313/402, 404, 405, 406, 313/407, 408

[56] References Cited

UNITED STATES PATENTS

| | | | |
|---|---|---|---|
| 3,890,526 | 6/1975 | Palac | 313/408 |
| 3,894,260 | 7/1975 | Sedivy | 313/405 |
| 3,896,321 | 7/1975 | Sedivy | 313/405 X |
| 3,912,963 | 10/1975 | Sedivy | 313/408 |

*Primary Examiner*—Robert Segal
*Attorney, Agent, or Firm*—John H. Coult

[57] ABSTRACT

This application depicts a rectangular color cathode ray tube having a faceplate and a mating funnel, on the faceplate of which is a system of four suspension devices, one at each corner of the faceplate, for detachably supporting a nonself-rigid shadow mask adjacent a screen-bearing inner surface of the faceplate. At least three of the mask suspension devices each comprise mask-mounted and envelope-associated components, the device being characterized by one of the components including an axially extending, nonfolded leaf spring which is cantilevered such that it deflects with an arc of motion in a plane perpendicular to the mask and preferably passing through the mask axis, and which has at its distal end provision for detachably engaging a mating provision on the other of the components. The leaf spring is arranged such that the force exerted by it on the mask is preferably through the mask along a diagonal thereof so as to preclude the imposition of any substantial moment on the mask. The leaf spring has a relatively low spring rate, (stiffness), i.e., in the flexure out of its plane, yet is very stiff in its own plane such that the three devices acting in concert precisely fix and hold the mask in a predetermined spatial position relative to the faceplate against translational or rotational displacement, in spite of any thermal expansion or contraction of the mask, demounting and remounting of the mask, or mechanical shocks and do so without deforming the mask.

21 Claims, 20 Drawing Figures

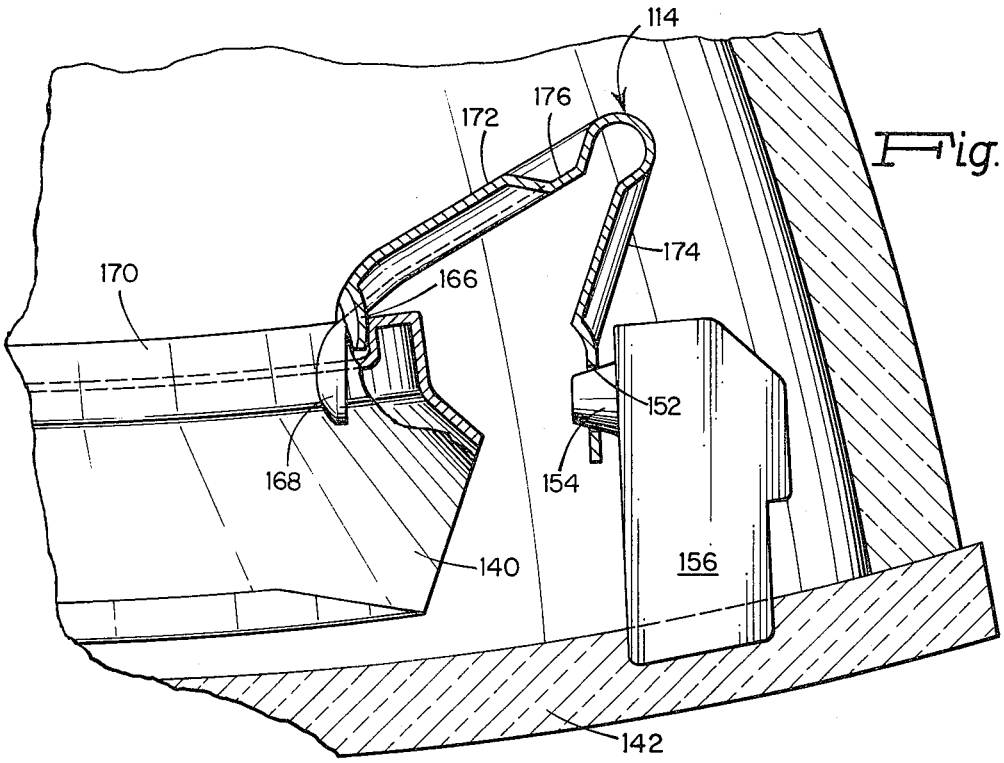
Fig. 13.
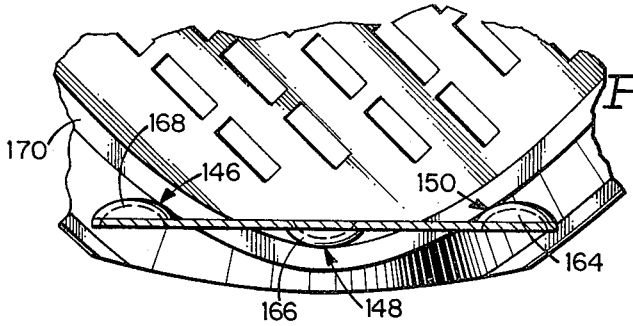
Fig. 15.
Fig. 14.
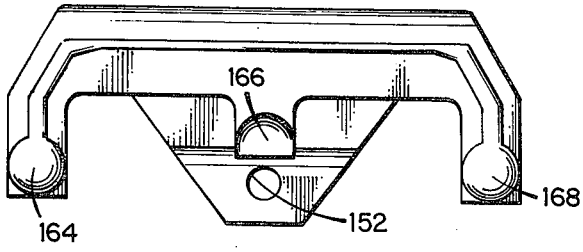
Fig. 16.
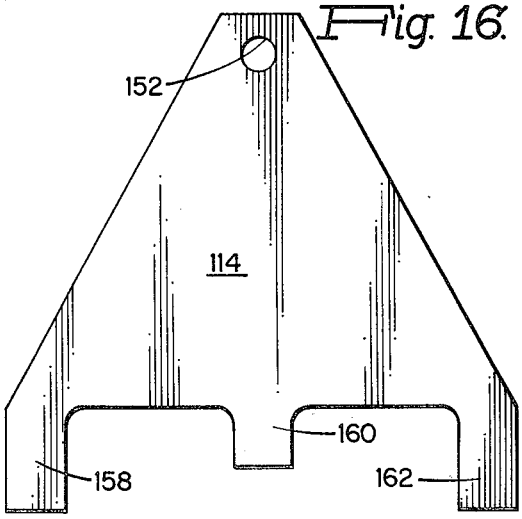

COLOR CATHODE RAY TUBE HAVING AN IMPROVED SHADOW MASK SUSPENSION SYSTEM

CROSS-REFERENCE TO RELATED APPLICATIONS

This application is related to, but in no way dependent upon, copending applications including Ser. No. 535,473, filed Dec. 23, 1974 (now U.S. Pat. No. 3,943,399, a continuation-in-part of now-abandoned application Ser. No. 395,106, filed Sept. 7, 1973); Ser. No. 395,334, filed Sept. 7, 1973 (now U.S. Pat. No. 3,912,963); Ser. No. 424,017 filed Dec. 12, 1973 (Now U.S. Pat. No. 3,896,321); Ser. No. 675,653, filed Apr. 12, 1976 (a second generation continuation of Ser. No. 285,985, filed Sept. 5, 1972 but now abandoned); Ser. No. 527,001 filed Nov. 25, 1974; Ser. No. 603,975 filed Aug. 12, 1975, and Ser. No. 603,973, filed Aug. 12, 1975, all assigned to the assignee of the present invention.

BACKGROUND OF THE INVENTION

This invention relates to color cathode ray tubes of the type having a shadow mask, and especially to a system for suspending a shadow mask on the faceplate of a color tube. This invention has applicability to suspension systems for shadow masks of various types, including post deflection focus masks.

Conventional color cathode ray tubes have a shadow mask assembly which includes a heavy frame to which is welded a dished, apertured mask. The frame is, by design, extremely rigid and provides the necessary rigidity for the mask. The mask-frame assembly is mounted in a conventional tube by a suspension system comprising three or four leaf springs which are welded to the frame at spaced points around the periphery thereof. These springs must be relatively stiff to suport the heavy mask-frame assembly, typically applying a load of 4–5 pounds or more to the mask-frame assembly. The springs have apertures at their distal ends which engage studs projecting inwardly from a rearward flange on the tube faceplate when the assembly is mounted in a tube. The mask-frame assembly is capable of being demounted and precisely remounted in a tube by depressing the springs to disengage the said studs. This type of system has proven to be commercially viable, however, the mask-frame assembly and the tube envelope are undesirably expensive.

The present invention is an improvement of a shadow mask suspension system constituting a radical departure from conventional and other prior art approaches to shadow masks and shadow mask suspension systems. According to that unique approach, a low cost, lightweight, non-self-rigid, torsionally flexible mask is provided. The faceplate is used to impart the necessary rigidity to the mask. A novel suspension system is provided which furnishes a mechanically rigid link between the faceplate and the mask, and yet which permits the mask to be conveniently and repeatably demounted and precisely remounted in the tube. The advantages of this system are manifold. A primary advantage resides in the appreciable savings in tube cost. Tube cost savings result from the use, in a preferred embodiment, of an envelope having a flangeless faceplate which is less expensive than the conventional flanged faceplate, and from the use of a lightweight (low mass), low cost shadow mask, preferably of one-piece, frameless construction.

A system of the type taught by this invention has imposed upon it a number of requirements and constraints not presented in conventional systems in which a rigid frame is used to impart rigidity to the mask. Before enumerating these requirements and constraints, a discussion of certain principles underlying this invention will be engaged. A shadow mask of the type with which this invention is concerned may be modeled as a rectangular four bar linkage affixed to a flexible sheet. Such a model is shown in Figure A. The four rigid bars of the linkage are designated A, B, C and D; the sheet is labeled S. As is well known, a four bar linkage is not inherently a rigid structure. The rectangular four bar linkge, in its free state, might, e.g., quite easily be skewed into a parallelogram geometry. It is evident, however, that the Figure A model cannot be skewed in its plane to take a parallelogram shape since it is affixed to the sheet S.

The linkage, can, however, be torsionally twisted about its diagonals, as shown for example in Figure B. In Figure B, the model has been twisted as follows — the linkage bar A has been rotated toward the reader (see arrows); the linkage bar C has been rotated away from the reader. The corners 1 and 3 have been displaced upwardly and the corners 2 and 4 have been displaced downwardly. The sheet S is thus stressed convexly along diagonal 2–4 and somewhat concavely at the ends of diagonal 1–3. The model may thus be thought of as being twisted about one of its diagonals (here shown as diagonal 1–3). It can be noted that the model configuration, after twisting, is changed substantially less along its major axis $M_a$ and minor axis $M_i$, than along the diagonals. Thus a four bar linkage affixed to a flexible sheet is relatively stiff with respect to its major and minor axes (due to the rigidity of the bars), but is relatively flexible in torsion. When torsionally flexed (twisted), about its diagonals, the corners are displaced, but points on the major and minor axes remain relatively stationary.

As will be pointed out in more detail hereinafter, the shadow mask with which this invention is concerned is similar to the described model in its mechanical characteristics.

The principles of this invention, though not limited to such application, are most useful when embodied in a color cathode ray tube having a flangeless faceplate. When such a faceplate is sealed to mating funnel after completion of the faceplate screening and mask insertion operation, the faceplate is very apt to experience a twist-wise elastic distortion due to a tolerance-related configurational mismatch between the funnel and faceplate sealing surfaces. Any such distortion will be rendered a permanent deformation when the sealing cement has cured and the sealing operation is completed. Thus, one of the necessary general requirements imposed on a mask and mask-suspension system intended for use with a flangeless faceplate is that it must be able to adapt to such twist-wise deformations of a faceplate with which it is mated. Stated another way, the mask must be capable of flexing or twisting about its diagonals in much the same way faceplates are apt to twist-wise deform in their contour during tube fabrication, and its suspension system must provide for such adaption. As will become evident as this description proceeds, the shadow mask and suspension system with which this invention is concerned are uniquely capable of meeting this requirement.

Second, and of equal significance — with respect to any given faceplate, since the mask is non-self-rigid, the suspension system for the mask must effectively transfer the rigidity of the faceplate to the mask.

Third, the suspension system must precisely fix and hold a predetermined spatial position of the mask as a whole relative to the faceplate against translational or rotational displacement, in spite of any thermal expansion or contraction of the mask, demounting and remounting of the mask, or mechanical shocks.

Fourth, it is desirable that any thermally induced movement of any part of the mask or of any mask suspension element during tube operation be radial, rather than tangential, since radial errors can be compensated by adjusting in the beam deflection characteristic, whereas tangential errors cannot be.

Fifth, it is desirable that the system permit the mask to be conveniently and quickly demounted and remounted, preferably automatically, since in conventional factory faceplate screening practices the mask is mounted on or demounted from the faceplate many times.

A sixth general requirement is that the mask suspension system should carry a low manufacture cost. A different type of shadow mask and suspension system thereof is disclosed in the patent to Fyler — U.S. Pat. No. 2,961,560. This patent shows a frameless shadow mask supported at a multiplicity of spaced peripheral points directly on projections from the concave screen-bearing surface of the tube faceplate. By this approach, it would appear that the rigidity of the faceplate is used to impart rigidity to the mask, thus eliminating the necessity for the mask to also be rigid. The Fyler approach would appear to suffer, however, (1) from an intolerable difficulty and inconvenience in the demounting and remounting of the shadow mask in the tube, an operation performed many times on conventional faceplate screening practices, (2) a difficulty in seating and reseating the mask uniformly on the multiplicity of support elements provided on the faceplate, (3) uncontrollability of the spatial position of the mask corners, and thereby a loss of color purity in the corners of the displayed images, (4) a probable shifting of the geometrical center of the mask upon thermal expansion and contraction thereof due to the non-equalized, frictional retention of the mask in the Fyler mask mounting system, (5) difficulty in achieving a commercially satisfactory "Q" compensation of the mask if such is necessary, and (6) a relatively high cost of system manufacture and assembly.

As will be pointed out in more detail hereinafter, this invention involves the provision of a shadow mask suspension system comprising four suspension devices, one at each corner of the tube faceplate, at least three of the devices including an axially extending cantilevered leaf spring. I have found that numerous additional specific requirements are imposed upon such a system, devolving in part from the corner location of the suspension devices, and in part from the use of a cantilevered type spring as an element of the device.

A seventh specific requirement is as follows. In order to achieve the afore-discussed fixing of the spatial position of the mask, in the context of a four-corner cantilevered spring suspension system, as described, it has been discovered that at least three of the springs must be extremely stiff in the plane of the spring. If the mask suspension springs are not sufficiently stiff in the plane thereof, i.e., in the tangential direction as mounted, and prefereably (though not necessarily) in torsion also, the mask will not always return to its bogey position (nominal assigned position) after having received a mechanical shock or after having been demounted and remounted. This fact is due largely to the mass of the mask and to friction at the points of engagement of the mask-mounted and envelope-mounted components of the mask suspension devices.

An eighth important requirement of the mask suspension system is that it provide a relatively constant and relatively low-valued radial spring loading on the mask, without the imposition of any significant moment tending to twist or deform the mask. Yet the mask must be supported against mechanical shocks which, e.g., may apply 45 G's or more to the mask. This requirement is especially important in a suspension system designed, as the present system is, especially for use with a lightweight, non-self-rigid mask capable of being distorted or deformed by an excessive loading or by a moment loading thereof.

A ninth (specific) requirement is that, in order that the suspension device not occupy a large area in the corner of the faceplate, which would require the provision of a larger-than-desired faceplate (and associated funnel), the deflection of the leaf spring to effect engagement or disengagement of the mask from the faceplate must be quite small. Further, the spring must not be so large as to require the provision of an intolerably great amount of space in the corner of the faceplate to accommodate same.

Tenth, the spring must be of a thickness, for certain embodiments of the invention, to be suitable for welding to a supporting structure. Further, the spring must not be overstressed during demounting or remounting of the mask and during thermal cycling of the tube during tube fabrication.

A prior art patent to Haas—U.S. Pat. No. 2,922,063 appears to disclose a suspension system for a shadow mask which is in some respects similar and in other respects very different from the suspension system of the present invention. Haas discloses a shadow mask having a lightweight frame to which is attached a perforate color selection mask. The mask is suspended adjacent the concave inner surface of a faceplate of the type having a rearwardly extending flange.

A suspension system is shown for suspending the mask which comprises four suspension devices located on the major and minor axes of the faceplate, each suspension device including a relatively wide leaf spring which is attached to the faceplate adjacent the seal land and extending forwardly to the mask frame. The springs are said to be "thin, flat metallic strips so that they are stiff in a lateral dimension but flexible in a direction perpendicular to the major flat face" (column 3, lines 48–51).

The Haas system is considered to have a number of major shortcomings which have perhaps been responsible for its apparent failure to have achieved commercial use. The leaf spring is apparently so flexible out of its own plane as to require that it be either screwed to a sealed-in flange (FIG. 4) or held on a faceplate-embedded stud by means of a special spring clip (55 in FIG. 5). In either arrangement, it is possible that any thermal expansion of the mask of frame would result in a moment being applied to the mask-frame assembly which would distort the mask and produce color impurity in the displayed images.

The Haas system would be further unsuited for use in the present system for failure to meet the afore-described first, fifth, and ninth requirements and perhaps others.

Yet another prior art approach is expounded by U.S. Pats. Nos. 3,450,920; 3,497,746; 3,529,199; 3,548,235; British No. 1,278,633; British No. 1,278,634; British No. 1,278,635 and British No. 1,172,334. In these systems, a shadow mask having a deep-drawn integral mask skirt, either with or without a frame, is mounted adjacent to the concave inner screen-bearing surface of a faceplate of the type having a rearwardly extending flange. Numerous ways are shown by which such a mask may be suspended on the faceplate flange by means of mask-mounted elements which are received in recesses formed integrally in the faceplate flanges. In certain embodiments the recesses are suggested for location on the faceplate flange sides. In other embodiments it is suggested that the recesses be located in the faceplate flange corners. The basic approach described in these patents would be totally incapable of meeting a number of the basic requirements imposed on a system of the type with which this invention is involved, described above. As a practical matter, it is impossible to consistently and repeatedly achieve the necessary accuracy in mask-to-faceplate registration in any mask suspension system in which large and unpredictable friction forces are produced. U.S. Pat. No. 3,529,199 also discloses a more conventional stud-spring suspension system (FIG. 2) but this too is deemed to be of little value in meeting the needs of a system of the type with which this invention is concerned.

The mask suspension systems of the referent copending applications have achieved noteworthy success in developmental tests in meeting the afore-described needs and requirements. This invention, however, represents an improvement over the systems of the said applications, as well as over the last-described prior art approach and over the Fyler, Haas, and all other known prior art systems.

OTHER PRIOR ART

| U.S. Pat. No. | |
|---|---|
| 2,823,328 | Vincent |
| 3,537,159 | Gartner |

OBJECTS OF THE INVENTION

It is a general object of this invention to provide a color cathode ray tube having an improved suspension system especially useful for corner-suspending a low cost, non-self-rigid, torsionally flexible shadow mask adjacent to the tube's faceplate.

It is another object of this invention to provide an improved corner suspension system for a non-self-rigid shadow mask which precisely fixes and holds a predetermined spatial position of the mask relative to the faceplate position against translational and rotational displacement, in spite of any thermal expansion or contraction of the mask, demounting and remounting of the mask, or mechanical shocks.

It is yet another object of this invention to provide an improved shadow mask suspension system by which the rigidity of an associated cathode ray tube faceplate is used to impart rigidity to the mask, thus making possible the use of a low cost, lightweight, non-self-rigid mask.

It is still another object to provide such a mask suspension system which enables a non-self-rigid mask to conform to and follow unit-to-unit twist-wise deformations of a supporting faceplate, and which will not significantly deform such a mask.

It is another object of this invention to provide such a mask suspension system which imposes a relatively constant and relatively low-valued radial spring loading on the mask, without the imposition of any significant movement tending to twist or deform the mask.

It is another object to provide such a mask suspension system in which the constituent suspension devices are extremely compact and unobstrusive and are thus particularly suited for corner-mounting a shadow mask.

It is yet another object to provide a mask suspension system having the afore-described qualities and yet which is relatively inexpensive and which permits convenient and rapid demounting and remounting of the mask.

BRIEF DESCRIPTION OF THE DRAWING

The features of the invention which are believed to be novel and unobvious are set forth with particularity in the appended claims. The invention, together with further objects and advantages thereof, may be best understood by reference to the following description taken in connection with the accompanying drawings, in which:

FIGS. A and B are schematic diagrams of a four-bar linkage model useful in understanding the mechanical properties of a shadow mask of the type with which this invention is concerned;

FIG. 13 is a side elevational view, partially sectioned, of a mask suspension device representing yet another embodiment of the invention;

FIG. 14 is an isolated rear view of a bracket-spring shown in FIG. 13;

FIG. 15 is a sectional view taken along a line in FIG. 13;

FIG. 16 is an unfurled view of the FIGS. 13–15 bracket-spring; and

DESCRIPTION OF THE PREFERRED EMBODIMENT

This invention is directed to providing an improved shadow mask suspension system which is especially useful for suspending upon the envelope of a color cathode ray tube a lightweight, torsionally flexible shadow mask such as is described and claimed, for example, in the referent copending application Ser. No. 395,334. As used herein, the term "shadow mask" is intended to encompass all tubes, including post deflection focus ("PDF") tubes, in which a color selection mask or electrode achieves a shadowing effect, whether total or only partial (as in a PDF tube). The present suspension system includes four suspension devices, one on at each corner of the mask. The general concept, however, of a lightweight, non-self-rigid, torsionally flexible, rectangular shadow mask which is supported at its four corners so as to permit it to conform to the contour of a cathode ray tube faceplate was first described and claimed in the above-noted copending application of K. Palac, Ser. No. 285,985.

FIGS. 1–4 illustrate a color cathode ray tube 2 incorporating a mask suspension system which implements the principles of this invention. The tube 2 is depicted as having an envelope comprising a funnel 4 sealed to a rectangular flangeless faceplate 6. The tube 2 includes a lightweight, rectangular, non-self-rigid, torsionally flexible shadow mask 12 of novel character described in detail and claimed in referent U.S. Pat. No. 3,912,963.

Figure 5:
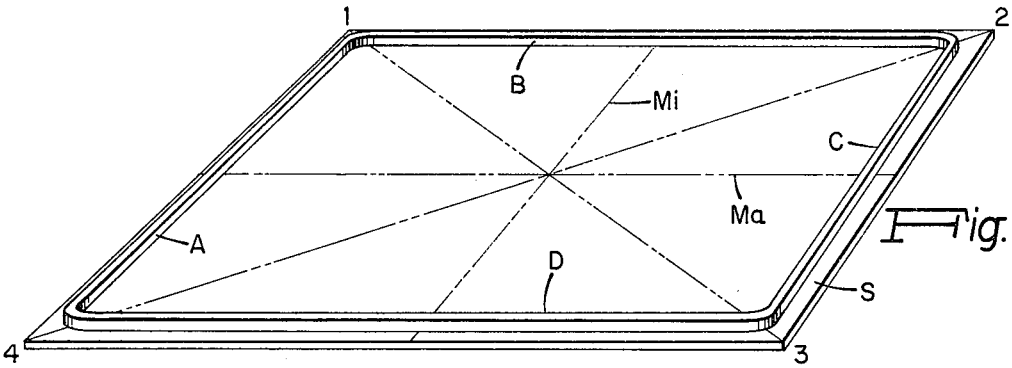
FIG. 5 is a highly schematic view of a faceplate-mask assembly shown in FIGS. 1–4; the Figure is useful in understanding certain mask suspension principles on which this invention is based.
Figure 5:
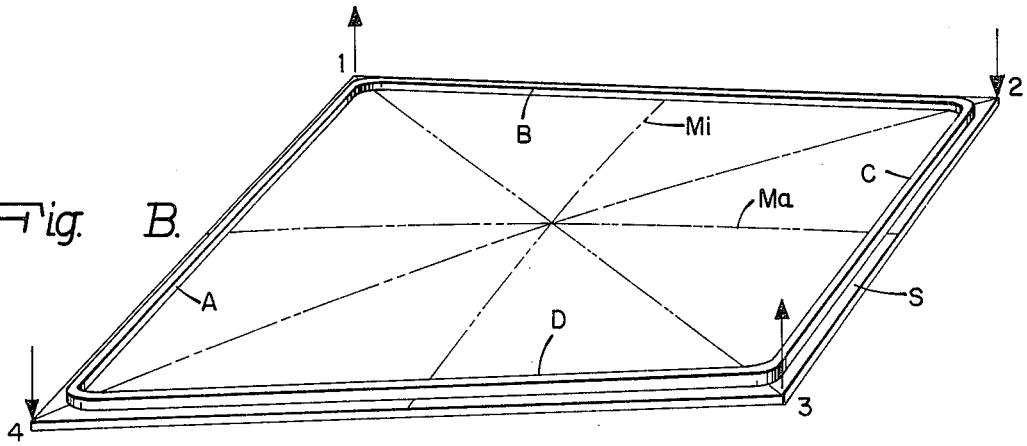
Figure 5:
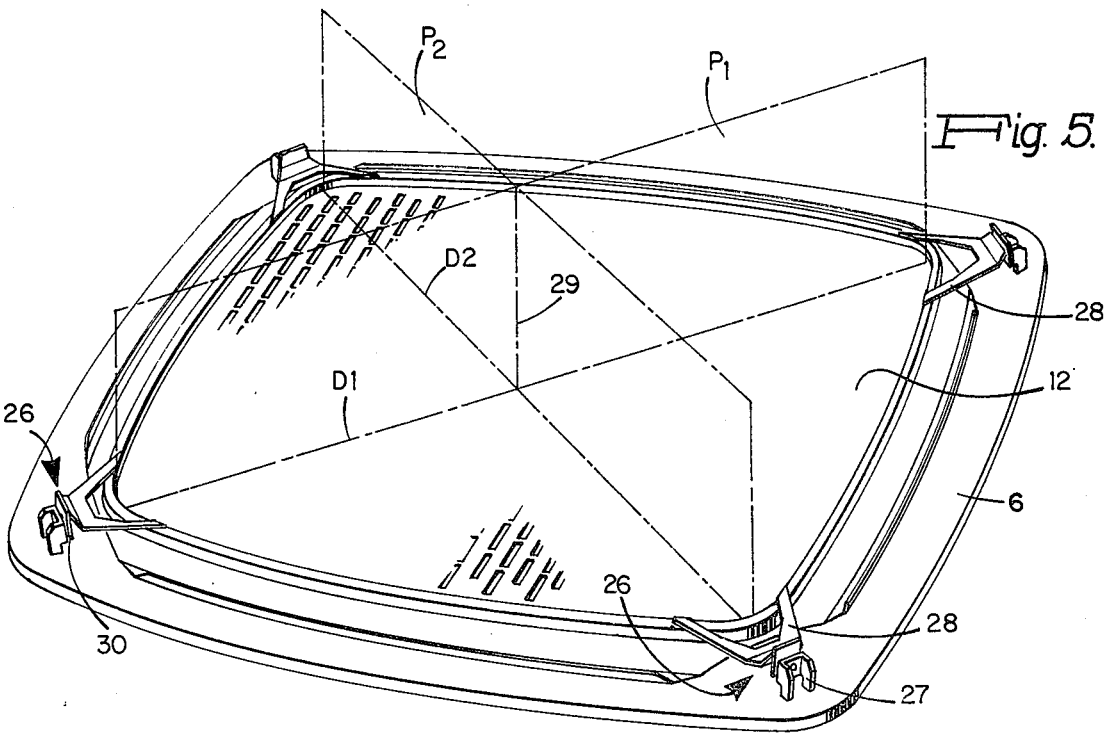

Before engaging in a discussion of the structural details of the mask 12 and its novel suspension system, a brief explanation of certain mask suspension principles underlying this invention will be given, particularly with reference to FIG. 5. In FIG. 5 there is shown, in schematic form, a faceplate 6 on which is mounted a shadow mask 12. The suspension system for the shadow mask is shown as comprising four suspension devices 26, one in each corner of the faceplate on a faceplate diagonal. The preferred structures for the suspension devices 26 will be described in more detail hereinafter. Only those parts of the suspension devices 26 which are pertinent to this discussion of principles will be mentioned at this point.

Each of the suspension devices includes an envelope-associated component, here shown as a stud 27, having thereon a provision for coupling the stud to a mask-mounted component of the suspension device 26. The suspension devices each also include a mask-mounted component, here shown as comprising a bracket 28 on which is mounted a leaf spring 30 having a provision for engaging the provision on the stud 27.

In the system with which this invention is concerned, the faceplate 6 is used, in effect, to impart rigidity to the mask 12. The suspension system acts as a rigid coupling between the faceplate 6 and the mask 12. Yet, by the provision of the spring suspension system, the mask 12 may be demounted and precisely remounted a number of times, a capability required by conventional faceplate screening operations. When the leaf spring 30 is deflected, the provision on the spring moves to achieve stud disengagement with an arc of motion in a plane preferably including a tube diagonal and the mask/tube axis 29 (the mask and the faceplate being coaxial).

As shown in FIG. 5, the said diagonal for the studs 27 in the left front and right rear corners of the faceplate 6 is designated $D_1$. The said plane in which the provision on the spring moves when the spring 30 is deflected is designated $P_1$ in FIG. 5. Line $D_2$ represents the other diagonal; the plane $P_2$ is the plane in which the provision on the suspension devices in the left rear and right front corners of the FIG. 5 faceplate move when their associated springs 30 are deflected.

Because the non-self-rigid mask 12 is easily flexed about its diagonals, and due to the corner mounting thereof, the mask is capable of conforming to twistwise deformation of the faceplate 6 on which the mask is mounted. Further, by introducing the suspension forces along the diagonals in the said planes $P_1$ and $P_2$, the mask corners are immobilized and the mask is held firmly and precisely positioned with respect to the faceplate 6. By the fact that the force exerted by the spring 30 on the mask 12 (when the mask is mounted) is along a diagonal, no substantial moment which might tend to distort the mask is imposed thereon.

As will be described in more detail hereinafter, each of the springs 30 is caused to have a relatively low spring rate i.e. in flexure out of its plane, yet be extremely stiff in its own plane. It can be seen that by this fact, the mask 12 is capable of being repeatably and precisely fixed in its spatial location relative to the faceplate, without its being deformed or distorted by the imposition of excessive loads or moment loads thereon. A full description of the suspension system and its components will be given below.

Figure 1:
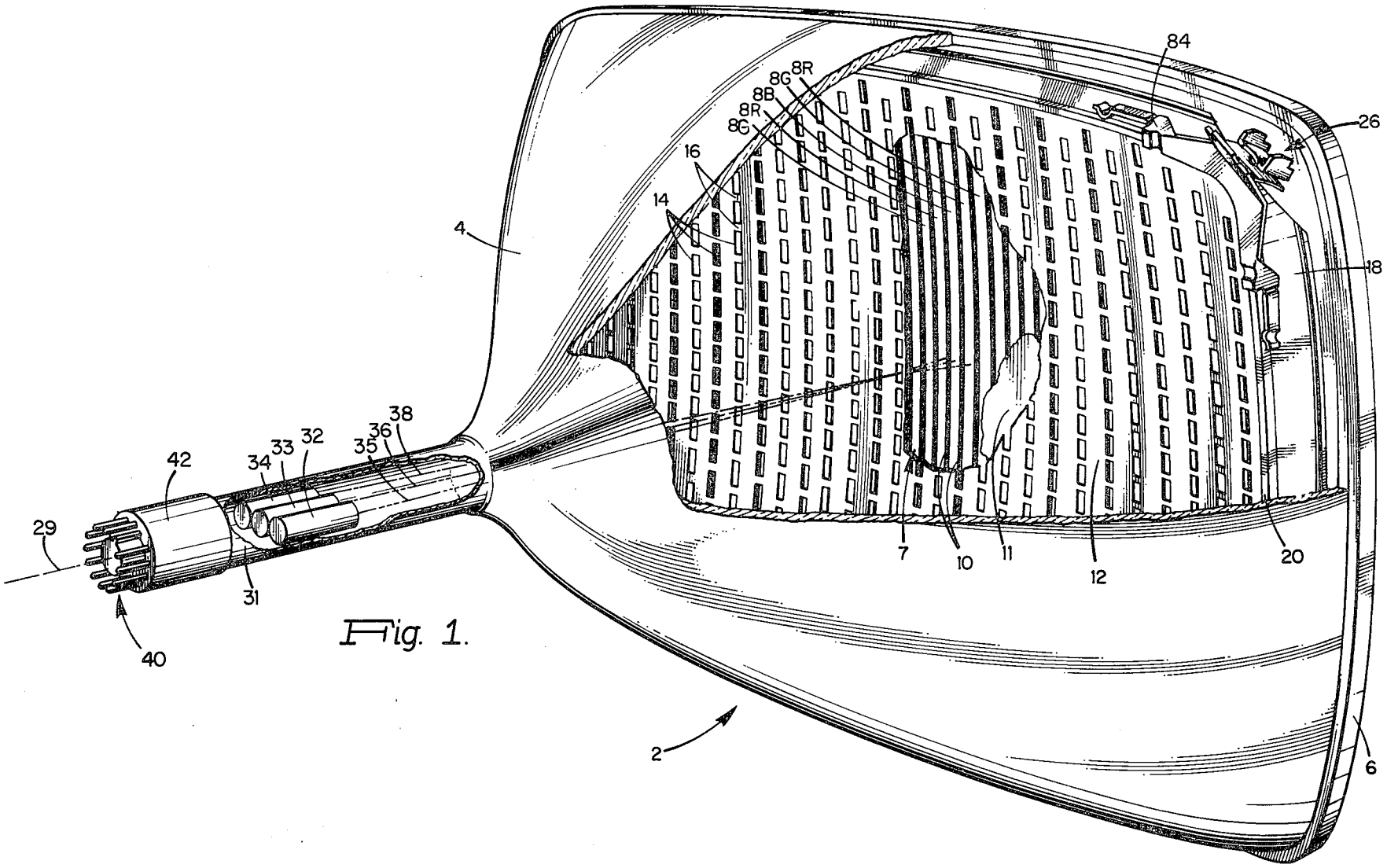
FIG. 1 is a perspective view, partly broken away, of a novel color cathode ray tube as seen from the rear, with a portion of the envelope cut-away to reveal a preferred suspension system for a shadow mask implementing the principles of this invention.
Figure 2:
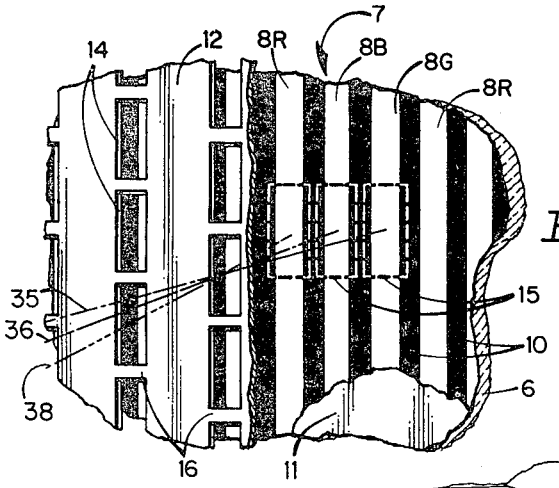
FIG. 2 represents an enlargement of a portion of the screen of the FIG. 1 tube.

Referring now also to FIGS. 1–4, the illustrated tube 2 is shown as having on the inner surface of the faceplate 6 a phosphor screen 7 (see FIG. 2). The screen is illustrated as comprising an array of vertically oriented, horizontally repeating triads of red-emissive, blue-emissive and green-emissive phosphor elements 8R, 8B and 8G. The screen is preferably of the negative guard-band, black matrix type as taught in U.S. Pat. No. 3,146,368. An aluminum layer is shown at 11. A black grille 10 comprises in this embodiment a pattern of light-absorptive bands separating the phosphor elements 8R, 8B and 8G.

The shadow mask 12 has a pattern of "slot" or "slit" apertures 14, spaced by "tie-bars" 16, which define beam landings 15. The shadow mask is, in general terms, described and claimed in the referent copending application Ser. No. 395,334. Briefly, the shadow mask 12 is non-self-rigid and may conveniently be of a frameless, one piece construction metal-formed from a single sheet of electrically conductive materials such as 6 mil thick, cold-rolled steel. An integral skirt 18 shields the screen 7 from stray and overscanned electrons. The skirt 18 and integrally formed channel 20 and edge lip 24 enhance the stiffness of the mask with respect to its major and minor axes, while permitting the mask to flex with respect to its diagonals and thereby conform, when mounted to the contour of the faceplate.

The tube is shown as including a neck 31, within which is contained an electron gun assembly. The electron gun assembly may take any of a variety of constructions, but in the illustrated embodiment wherein the mask is a slot mask cooperating with a screen of the "line"-type, the electron gun assembly preferably is of the "in-line"-type, comprising three separate guns 32, 33, 34 generating three coplanar beams 35, 36, and 38 which carry, respectiely, red-associated, blue-associated and green-associated color video information. The electron gun assembly is electrically accessed through pins 40 in the base 42 of the tube.

Figure 3:
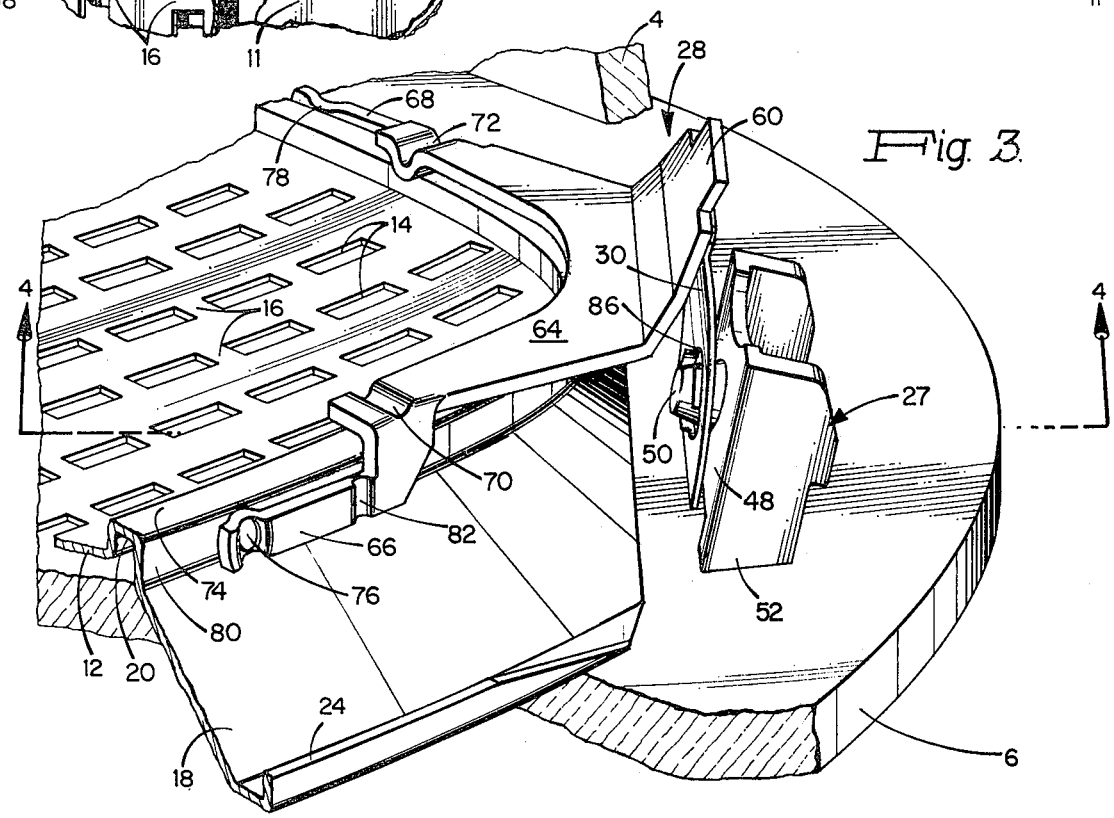
FIG. 3 is an enlarged fragmentary perspective view, shown partly sectioned and broken away, of a corner of the tube shown in FIG. 1, revealing with particular clarity one of the suspension devices for mounting the shadow mask on the tube faceplate.
Figure 4:
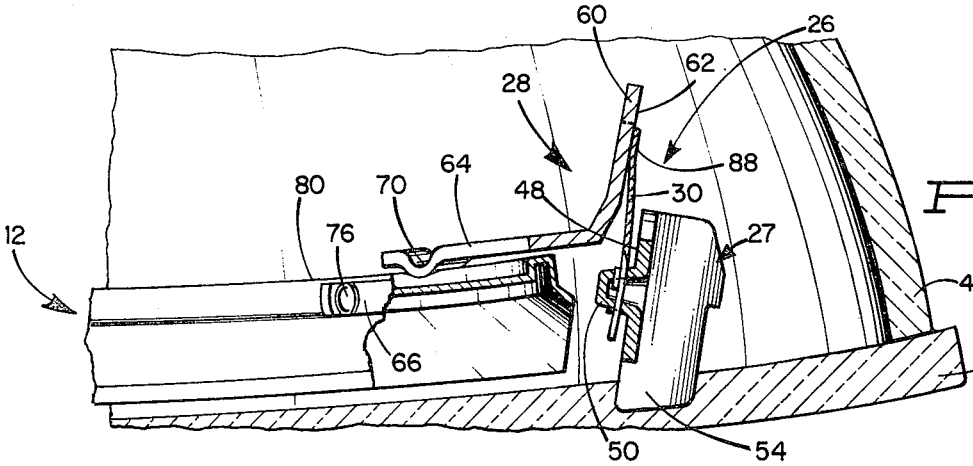
FIG. 4 is a sectional view taken generally along lines 4—4 in FIG. 3.

A mask suspension system constructed according to this invention will now be described. FIGS. 3 and 4 show a preferred mask suspension device 26 which may be employed on at least three of the four corners of the mask 12. The device for the fourth corner must hold the proper Q spacing (the spacing between the mask and the screen-bearing faceplate surface), while allowing the fourth corner of the mask to seek an equilibrium position in its own plane. The requirements on the fourth corner device are thus somewhat different than for the other three devices, permitting the fourth device to be of somewhat different construction, as described below.

The illustrated mask suspension device 26 includes envelope-associated means on the tube faceplate. Whereas numerous other envelope-associated means are contemplated by the present invention, in the FIGS. 1–4 embodiment the envelope-associated means is shown as taking the form of a stud 27. The stud 27 does not per se, constitute an aspect of this invention, being described and claimed in the referent copending application Ser. No. 527,001.

The stud 27 is preferably a sheet-metal stamping and is illustrated as having a channel shape with a forwardly extending face 48 containing an integral protuberance or lug 50 and two legs 52, 54 which are embedded in (of which may, in another form, be cemented to) the faceplate 6.

The spaced legs 52, 54 permit screening fluids suffused across the faceplate during the faceplate screening operations to pass through the stud 27 without clogging it and without creating reflection marks in the end-product screen. As will become evident as this description proceeds, the positioning of the stud 27 and particularly the lug 50 must be to within very tight tolerances in order that the shadow mask 12 will be suspended precisely at the desired Q spacing.

In accordance with the FIGS. 1–4 embodiment of the present invention, the suspension device 26 also includes mask-mounted means for retentively and detachably engaging the envelope-associated means (here shown as the stud 27). The mask-mounted means may take various forms, but is here shown as including a stiff bracket 28 externally surrounding and embracing a corner of the mask 12, and a novel cantilevered leaf spring 30 (described below) affixed to the bracket 28 and having provision for retentively engaging the stud 27. The bracket 28, per se, constitutes an aspect of an invention described and claimed in referent application Ser. No. 603,975.

The bracket 28 extends around a corner of the mask on the outside and in the plane thereof. The bracket 28 is secured to the mask on at least three points, two points being located one each on adjoining sides of the mask corner to impart tangential rigidity to the bracket connection. A third point is located spaced from a line joining the two points so as to impart rigidity to the bracket connection in a plane parallel to and passing through the mask axis. the bracket 28 is illustrated as including a head 60 having a radially outwardly directed face surface 62 preferably extending parallel to the mask/tube axis 29 when the mask is operatively mounted within a tube. The bracket 28 includes a pair of diverging arms 63, 64 extending transversely to the mask/tube axis 29. The arms 63, 64 each have a provision, here shown as dimples 70, 72, intended to be welded to a mask surface, here shown as the back surface 74 of channel 20.

The arms 63, 64 have a pair of wings 66, 68 bent out of the plane of the arms 63, 64. Each of the wings 66, 68 has an area on its distal end, here shown as dimples 76, 68, intended to be welded to a side surface of the mask, here shown as side surface 80 of the channel 20. The wings 66, 68 have, at a point between the supporting arms 63, 64 and the proximate dimple, a provision having a radial yield prior to attachment, here shown as thinned-down sections 82, 84. The thinned-down section in each of the wings 66, 68 provides a radial yield (out of the plane of the wing) before welding, but yet provide high rigidity in the mask's axial direction. The bracket 28 may, for example, be formed from 60 mil thick cold-rolled steel. The bracket may, if desired, be provided from a laminated bi-metal material to provide thermal Q compensation for the mask. Other properties and features of the bracket and preferred methods of assembly will be described and will be better understood after a discussion of the spring 30.

Figure 6:
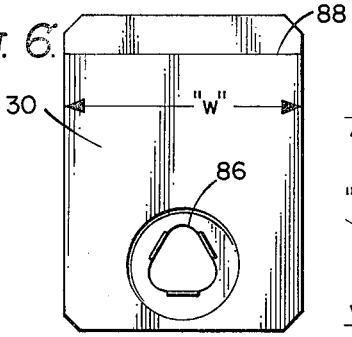
FIGS. 6 and 7 are isolated front and side elevational views and a spring constituting part of the suspension devices shown in FIGS. 1, 3, and 4.
Figure 7:
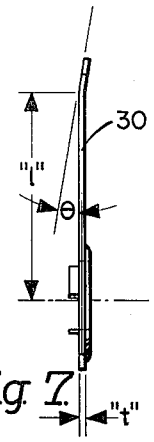

The leaf spring 30 constitutes an important aspect of this invention and will now be described in detail. The spring 30 is shown as being welded at one end to the face surface 62 of the head 60 of bracket 28 and in the illustrated embodiment extends toward the faceplate. A provision on the distal end of the spring, here shown as an aperture 86, retentively receives the mating lug 50 on the stud 27 when the mask 12 is operatively mounted in a tube. The leaf spring 30 is shown in isolation in FIGS. 6 and 7. In the illustrated embodiment, the periphery of the aperture 86 has been stamped to assume a shape which will discourage frictional "hanging up" of the spring 30 on the lug 50. It is here noted that the lug could as well constitute part of the mask-mounted component and the aperture could be in the stud 27. However, in that case, the reaction force imposed by the stud aperture on the lug would be displaced from the plane of the spring, producing a moment on the spring. The possible result (though unlikely) of the application of such a moment to the spring is a misengagement of lug and aperture which might alter the position of the mask relative to the faceplate, or the mask geometry. The illustrated arrangement (with the aperture in the spring rather than in the stud) precludes this possibility.

As briefly discussed above in connection with FIG. 5, the leaf spring is cantilevered such that it deflects with an arc of motion in a plane perpendicular to the mask and preferably passing through the mask/tube axis in order that forces exerted on the mask by the spring are substantially radial. The force exerted by the spring 30 is preferably substantially along a mask diagonal to preclude the imposition of any substantial moment (in the plane $P_1$ or $P_2$ — FIG. 5) on the mask which might cause the mask to be deformed.

It would be ideal if the mask, particularly a non-self-rigid mask such as mask 12, were subjected to zero loading by its support system. However, such is not believed to be possible in a spring-type support system structured for a rapid, precise and convenient demounting and remounting of the mask. It is advantageous, however, to cause the mask loading force to be as low as possible, for a given minimum necessary spring deflection, consistent with the many other mask support requirements and constraints. An excessive load exerted on the mask will cause it or its suspension system to deform. This is an especially serious problem during thermal cycling of the tube, as when the faceplate and funnel are frit-sealed at 400° C or more. The mask expands to its greatest dimensions under such conditions and maximum mask loads are generated. Yet the spring 30 must exert sufficient force that upon mechanical shocking of the tube, the shadow mask will not be disengaged.

Preferably the spring 30 has a relatively low spring rate, i.e. stress-versus-deflection characteristic, in order to minimize the variations in spring forces imposed on the mask as a result of tolerance-related variations in spring deflection. Such tolerance-related variations may be caused, e.g., by tolerance errors in the configuration or mounted geometry of bracket 28, or in the location of the stud 27 on the faceplate 6.

The spring is very stiff in its own plane, and preferably also in torsion (particularly in applications, as described above, where the spring carries the lug and the stud has the lug-receiving aperture) in order that three of the suspension devices acting in concert will precisely fix and hold the mask in a predetermined spatial position relative to the faceplate against translational or rotational displacement, in spite of any thermal expansion or contraction of the mask, demounting and remounting of the mask, or mechanical shocks. It can be seen by reference to FIG. 5, for example, that with three of the four leaf springs being very stiff in their respective planes, and with their distal ends constrained, the mask is completely immobilized and its position relative to the faceplate fixed.

The suspension system of the present invention differs in a number of important respects from the prior art suspension systems described and claimed in the referent U.S. Pats. Nos. 3,943,399 and 3,896,321. The springs of the systems described in those applications are folded and have a small amount of flxibility in the tangential direction. In the system of the present invention, at least three of the four mask suspension devices employ leaf springs which are non-folded and otherwise caused to have an insignificant amount of flexibility in the tangential direction. The result is an improved capability of accurately and repeatably positioning the mask relative to the faceplate in spite of thermal and mechanical influences.

As noted above in the background discussion of the invention, the spring 30, being corner-located, must be compact, have a relatively small deflection, must not be over-stressed during demounting or remounting or during thermal recycling of the tube, and desirably should otherwise meet the aforedescribed requirements imposed thereon.

It is noted that in the design of a system of the character herein described and claimed, the effective length (i.e., cantilevered length $l$), the width $w$, and the thickness $t$ of the spring are all of extreme importance. As noted, the deflection of the spring required to demount or remount the mask must be sufficiently large to permit these operations to be readily performed manually or with automated equipment, and yet the deflection cannot be so great so as to require an intolerably large amount of space in the tube enclosure. The spring must be thin to prevent excessive stressing thereof upon deflection, yet not so thin as to buckle when the tube is drop-tested (a test which exerts up to 45 G's on the mask suspension system). The thickness of the spring must also be taken into consideration in connection with welding of the spring to a support member, if such is necessary.

As noted, the load imposed by the spring on the mask must be adequate to prevent dislodgement of the mask in the event of mechanical shocks, and yet cannot be so great as to deform, the mask, particularly during thermal cycling of the tube wherein the mask is thermally enlarged in size. Further, the load value must be relatively insensitive to thermal cycling of the tube. The spring parameters must be chosen, along with the material considerations, such that over-stressing of the spring will not result.

It has been found that (for constant load) if, e.g., while holding other parameters fixed, the width of the spring is increased, the bending stresses on the spring will be reduced; however, the deflection (for a given load) is apt to be undesirably reduced. But, to increase the deflection to an acceptable value, it is apt to be necessary to reduce the thickness of the spring below a minimum thickness which will enable the completed tube to pass the drop tests or which will cause the bending stresses on the spring to increase to an undesirable level.

Further, it has been found that if the width of the spring is excessively decreased, the spring is apt to lose its necessary tangential stiffness (in its own plane), and, for a fixed deflection, the applied load is apt to drop below an acceptable value.

If the effective length of the spring is reduced too far, the radial stresses will increase beyond a permissible limit. Increasing the effective length of the spring will result in a reduction in the radial stresses in the spring, but is apt to result in an intolerably reduced applied load on the mask. The space requirement also increases with increasing spring length.

Taking all these and other factors into consideration, in accordance with this invention, the ratio of the width $w$ to the thickness $t$ of the leaf spring 30 is caused to be between about 25 and 300, and the effective length $l$ thereof is between about $0.5w$ and $1.5w$. The desirable part of the range of the length-to-width ratio has been found to be where the effective width is approximately equal to the effective length of the spring, ideally about 0.9 feet 1 inch. The loading of the mask by the spring has been found desirably to be between about 0.34 pounds and 2.4 pounds for a spring deflection of between about 50–270 mils. Ideally, the loading is about 0.7 pounds and the spring deflection about 90 mils. In a system constructed and very successfully tested, the spring had a bend angle "$\theta$" (see bend line 88 in FIG. 7) of about 6°. The active length $l$ of the spring from the bend line to the center line of the aperture 86 was about 0.7 inch (the overall spring length was about 0.95 inch). The width of the spring was about 0.79 inch and the spring was composed of 0.008 inch 17–7 PH stainless steel, heat-treated to a condition RF 950.

It is another important aspect of this invention that at least three of the four suspension devices by very stiff in a tangential direction and fix the spatial position of the mask in the plane thereof. The fourth suspension device must have provision for permitting the fourth corner of the mask to seek an equilibrium position in the plane of the mask, while cooperating with the other devices in precisely fixing the Q spacing of the mask.

Figure 9:
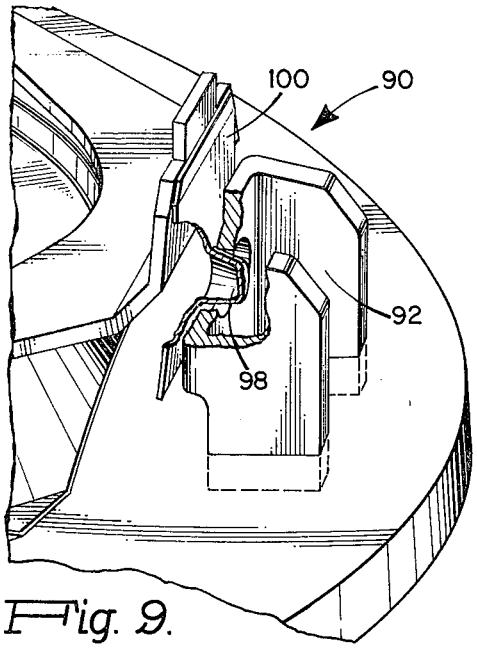
FIGS. 8 and 9 illustrate a mask suspension device representing one of the four devices constituting the FIGS. 1–4 system.
Figure 8:
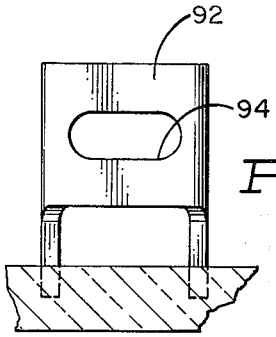

To this end, the fourth suspension device, that is the suspension device that is not like the other three and provides redundancy compensation, may be of somewhat different construction than the other three suspension devices. Referring particularly to FIGS. 8 and 9, there is shown a mask suspension device 90 which may be employed as the said fourth suspension device.

As shown in FIG. 8, there is provided a stud 92 having a construction somewhat similar to that of stud 27, but having two main differences. First, mask engagement provision in the stud is an aperture 94 rather than a lug, and the provision in the stud is elongated in a direction parallel to the faceplate inner surface when the stud is mounted. FIG. 9 shows the mask-mounted component of the fourth suspension device 90. The mask-mounted component is generally similar to the mask-mounted components of the device 26, but has a lug 98 at its distal end, rather than an aperture. The lug is here shown as being integral with the spring 100, but alternatively may be made initially as a separate element. The lug 98, upon engagement with the elongated aperture 94 permits the fourth corner of the mask to seek an equilibrium position in its own plane (which position is determined by the other three suspension devices), and yet the proper Q spacing between the mask and the faceplate inner surface is maintained.

This system also has the important added feature that it dictates the rotational orientation of the mask relative to the faceplate. If all four mask-mounted components on the four corners of the mask were identical, the mask could be mounted on the faceplate in either of two possible orientations (180° apart). It is desirable, however, to predetermine the mask orientation relative to the faceplate and have that orientation preserved throughout the various tube fabrication steps since the pattern of apertures in the shadow mask is used as a photographic stencil in the deposition of the mosaic of phosphor elements on the phosphor screen. If the mask were in one orientation when it was used as a photographic stencil during screening of the faceplate, and rotated 180° when mounted for final assembly, the registration of the mask apertures with the phosphor screen would be lost.

The system represented by FIGS. 1–9 wherein three of the suspension devices have the male members on the envelope-associated component and one male member on the mask-mounted component of the fourth device (or vice versa) does not, per se, constitute an aspect of this invention but rather is specifically described and claimed in referent copending application Ser. No. 603,973.

Figure 10:
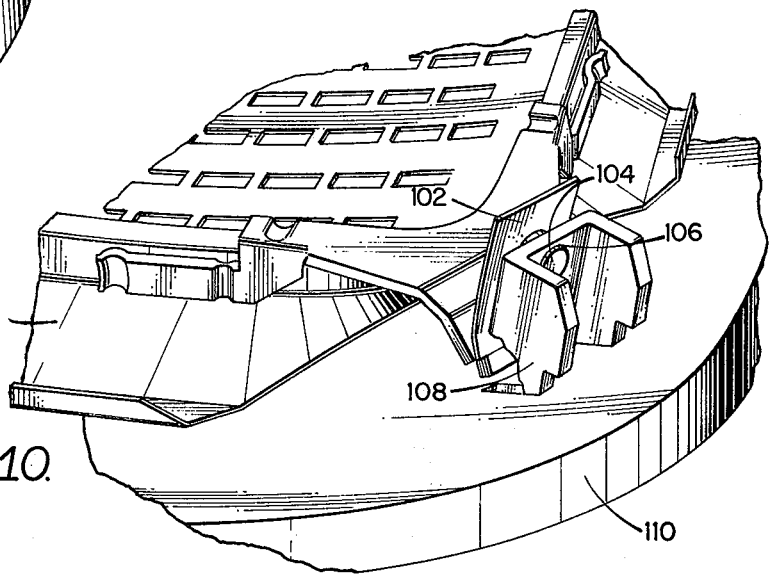
FIGS. 10–12 are schematic perspective views of alternative mask suspension devices which may be constructed according to the principles of this invention.

The present invention may be implemented with a variety of structures. Whereas the FIGS. 1–9 embodiment has the leaf spring constituting part of the mask-mounted component and extending toward the faceplate, other configurations are possible. For example, FIG. 10 shows an arrangement wherein the leaf spring 102 extends away from the faceplate and contains a lug 104 for engaging an aperture 106 in a stud 108 embedded in the faceplate 110. This arrangement has the advantage over the afore-described structure that as the mask 112 expands, due to thermal heating of the mask during tube operation, the mask will be moved slightly closer to the screen and thereby compensate for mask-expansion-related color degradation in the reproduced images.

Figure 11:
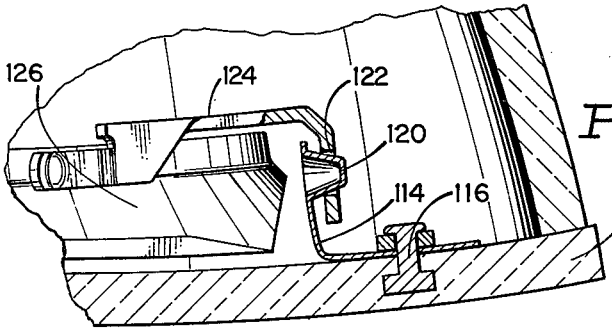

FIG. 11 shows an arrangement wherein the cantilevered spring 114 is mounted by a stud 116 and extends away from the faceplate 118. The spring has a lug 120 formed at its distal end which is adapted to engage from the inside an aperture 122 in a bracket 124 carried by a corner of the shadow mask 126.

Figure 12:
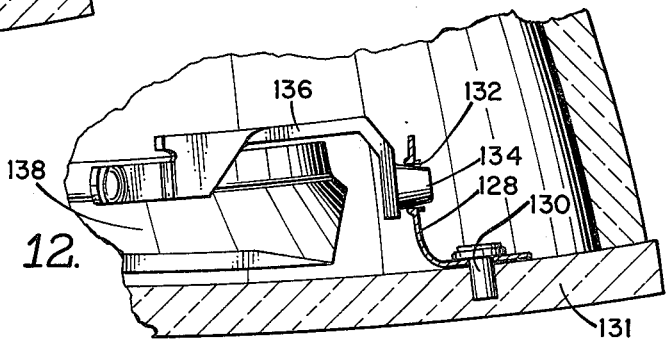

FIG. 12 shows yet another arrangement wherein the cantilevered leaf spring 128 is mounted by a faceplate-embedded stud 130 so as to extend away from the faceplate 131. The spring has at its distal end an aperture 132 adapted to retentively receive a lug 134 extending from a bracket 136 on a corner of shadow mask 138.

FIGS. 13–16 illustrate an embodiment of the invention wherein the spring and a supporting bracket are formed integrally from a single element of sheet material. In FIGS. 13–16 there is depicted a corner of a color cathode ray tube, and particularly a suspension device for suspending a corner of a shadow mask 140 adjacent the inner surface of a faceplate 142. The suspension device is illustrated as comprising an integral one-piece bracket-spring member 114. The member 114 is welded to the mask 140 at three areas 146, 148, 150 and has at its distal end an aperture 152 for retentively receiving a lug constituting part of a mask-supporting stud 156. The bracket-spring member is shown unfurled (before being stamped) in FIG. 16. After stamping, the three tabs 158, 160, 162 are formed to have dimples 164, 166, 168 which are welded to a channel 170 constituting part of the mask 140. As shown, the center dimple 166 is welded on the inside of the channel 170 and the outside dimples 164, 168 are welded to the outside of the channel 170. The bracket-spring member has two basic portions, divided by their function — a bracket portion 172 and a spring portion 174.

The bracket portion 172 has formed integrally therein stiffening corrugations 176 and is otherwise formed for enhanced stiffness. The spring portion 174 is similar in structure, function and operation to the spring 30 in the FIGS. 1–9 embodiment.

It is noted that in suspension systems constructed according to this invention, all thermally induced movements of any part of the mask or of any mask suspension element are purely radial. For example in the FIGS. 1–9 embodiment, if the bracket 28 should warp slightly during normal frit sealing or exhaust cycles, any net geometrical displacement will be in the axial direction, and is thus correctable by adjustments in the beam scanning apparatus.

It is important that the leaf spring in each and all embodiments of the invention have the proper position relative to the associated studs. Referring for example to the FIGS. 1–9 embodiment, it is important that the bracket 28 be precision-mountable in prescribed radial and tangential position on the mask 12 in order that the leaf spring 30 have a predetermined appropriate position relative to the stud 27, and in order that the bracket 28 does not interfere with the stud 27 or other envelope or envelope-associated structures. It is also important that the loading of the spring 30 against the stud 27, and thus the loading of the mask 12, be within a prescribed range of loading values and be relative constant from unit-to-unit.

There will now be described a method for assembling the mask-mounted component of certain of the mask suspension devices (device 26 in the FIGS. 1–9 embodiment for example) in order to meet the aforestated requirements.

This method is most relevant to the subject matter of referent application Ser. No. 603,975. It is important that the face surface 62 on the head 60 of the bracket 28 be parallel to the mask axis and at a prescribed radial distance therefrom. To assure this, a fixture is provided having a flat surface positioned at the precise radial distance from the mask axis and oriented with precise parallelism to the mask axis. Before welding of the bracket 28 to the mask 12, the face surface 62 is brought into intimate engagement with said surface of the fixture. The bracket is then lowered parallel to the tube-mask axis until the dimples 70, 72 make engagement with the back surface 74 of the channel 20 by prebending the wings 66, 68, at the point of the thinned down sections 82, 84 inwardly through an angle sufficient to insure that the wings 66, 68 are sure to engage the side surface 80 of a mask being operated on, it is assured that the dimples 70, 72 as well as the dimples 76, 78, will engage the mask 12 when the bracket 28 is properly positioned by the aforesaid fixture. The four dimples 70, 72, 76, and 78 are then welded to the mask, assuring a proper positioning of the bracket 28 on the mask 12.

To assure a proper positioning of the aperture 86 in the spring 30 relative to the apertured central portion of the mask 12, and thus to insure the proper Q spacing of the mask, the spring 30 is welded on the face surface 62 of the bracket head 60 while the aperture 86 is positioned in a fixture which assures the correct Q spacing of the mask from the phosphor screen.

Reiterating, a significant feature of the suspension device 26 is the four point attachment of the bracket 70 (two points on the top surface 74 of the channel 20 and two on the side surface 80). This permits the bracket 28 to be aligned in an assembly fixture with the bracket face surface 62 parallel to the tube/mask axis and perpendicular to the intersecting mask diagonal, while allowing the dimples 70, 72, 76, and 78 to seat firmly on the mask. When the welds are made at the four dimples, the bracket is fully restrained in all axes, maintaining the desired orientation of the bracket face surface 62 with high stiffness. This is accomplished with no significant stresses in the mask and bracket, an important ingredient in the achievement of a high degree of tube performance.

The thinned-down sections 82, 84, on the wings 66, 68 permit the additional location control required to maintain the bracket face surface 62 at the proper radial distance from the tube axis by providing radial yield prior to welding. The wings are slightly over-bent inwardly and are allowed to "give" when the bracket is fixed on the mask at the correct radial position. The thinned-down sections 82, 84 thus provide a low-force yield point for accommodation of manufacturing tolerances. Note that any residual stresses at this yield point results only in a pinching of a corner of the mask and do not contribute to any significant bracket or mask distortion or movement. Also, after welding, no further bending loads can be applied to the thinned-down sections 82, 84 about the weak axis thereof; the width of the thinned-down sections along the "long" or "strong" axis still serve to maintain the rigidity of the bracket 28 in the fixtured location.

A second method for assembling the bracket 28 and spring 30 on a mask 12 will now be described. Rather than attaching the bracket 28 to a mask by the use of an appropriate fixture, and then attaching the spring 30 to the bracket 28, the bracket 28 and spring 30 may be welded together while referencing both to a dummy or simulated mask having nominal mask dimensions. The bracket/spring assembly is then welded at the four dimples 70, 72, 76, 78 to an actual mask. Because the mask 12 is formed accurately by a high precision die, dimensional variations from mask to mask are small. Such variations result only in minor spring force changes, but because of the described fixturing means, the Q spacing will remain unchanged. To assemble the bracket/spring assembly to a mask, the assembly is positioned in a fixture with reference to the spring aperture 86 (for proper mask Q spacing) and with reference to the face surface 62 (for radial and tangential orientation) and is then welded at the dimple points to the mask.

Whereas the invention has been described with respect to exemplary embodiments thereof, it is evident that many alterations, modifications and variations will be apparent to those skilled in the art in light of the above disclosure. For example, whereas the above-described mask suspension system is most useful, for the reasons given, when applied in a tube having a flangeless faceplate, the suspension system of this invention, because of the substantial cost savings it offers, may be incorporated in a tube of a type having a conventional flanged faceplate, as shown for example at 180 in the FIG. 17.

Figure 17:
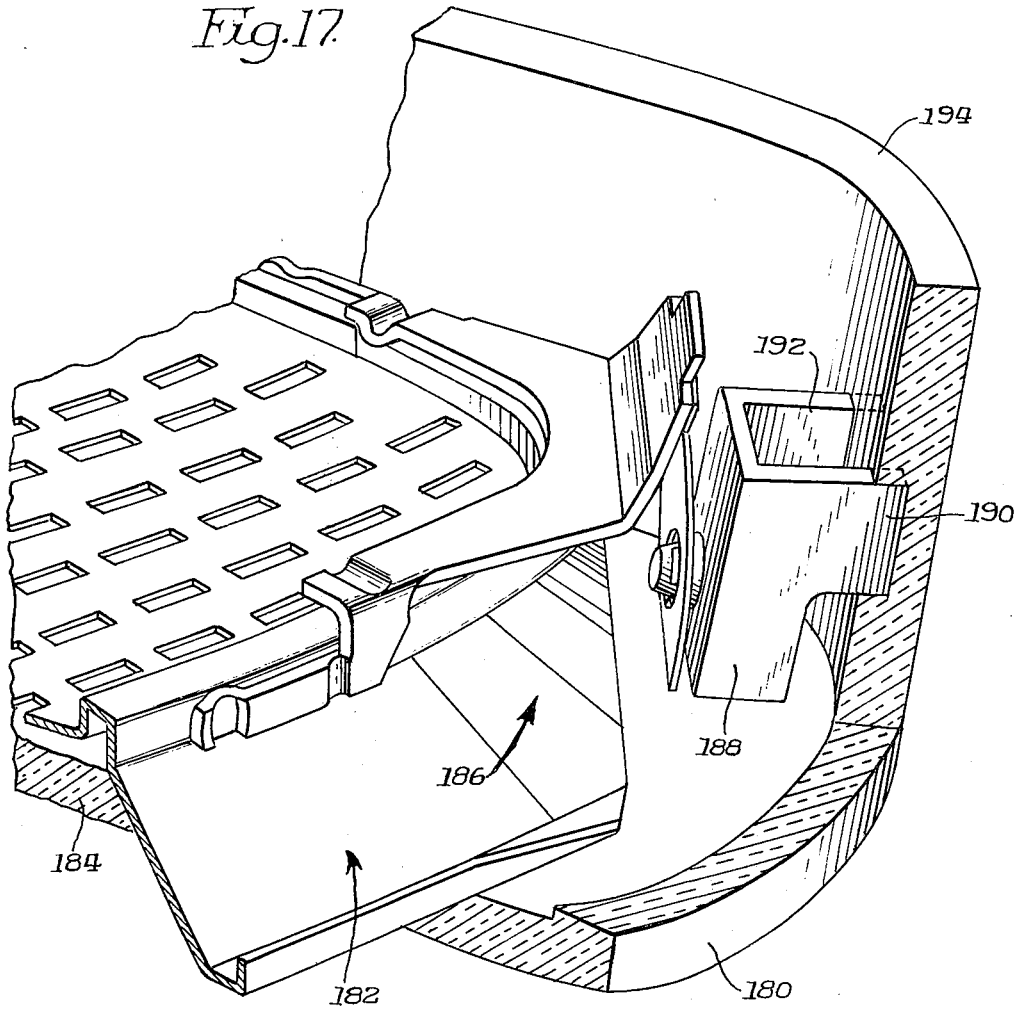
FIG. 17 is a fragmentary perspective view similar to FIG. 3, of a mask suspension device representing yet another embodiment of the invention.

FIG. 17 shows a shadow mask 182, which may be of the character described above with respect to FIGS. 1–4, suspended adjacent to the screen-bearing inner surface 184 of the faceplate 180 by four corner-located mask suspension devices 186. The mask suspension devices 186 may be constructed similar to the mask suspension devices shown in FIGS. 1–4 except that the stud, rather than being a stud as shown at 27 which is embedded in an extension of the screen-bearing inner surface of the faceplate, is a modified stud 188 having a pair of legs 190, 192 which are embedded one in each corner of the rearward flange 194 on the faceplate 180.

Figure 9A:
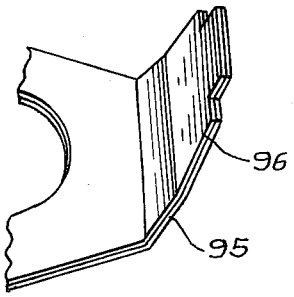
FIG. 9A shows an alternative bracket structure.

Whereas the brackets depicted in the above-described embodiments are believed to be preferred, numerous modifications and variations may be employed within the spirit and scope of the present invention. Although it is believed that the mask 12 will not require any Q compensation, i.e., deliberate variation of the mask-to-faceplate spacing (the Q distance) to compensate for thermally induced mask expansion and contraction, in any application where such may be desired, it can be provided by causing the bracket 28 to be composed, at least in its crucial parts, of a laminated (face-bonded) bimetallic material. FIG. 9A shows such a bracket wherein the two components of the laminate structure are shown at 95 and 96 and represent metals having suitably different coefficients of expansion. Whereas a preferred spring structure has been shown, other spring structures and arrangements are contemplated to be within the purview of this invention. Accordingly, I intend to embrace all such alterations, modifications and variations which fall within the spirit and scope of this invention.

What is claimed is:

1. In a rectangular color cathode ray tube having a faceplate and a mating funnel, a system of four suspension devices, one at each corner of the faceplate, for detachably supporting a non-self-rigid shadow mask adjacent a screen-bearing inner surface of the faceplate, at least three of said mask suspension devices each comprising mask-mounted and envelope-associated components, said device being characterized by one of said components including an axially extending, non-folded leaf spring which is cantilevered such that it deflects with an arc of motion in a plane perpendicular to the mask and which has at its distal end provision for detachably engaging a mating provision on the other of said components, said leaf spring being arranged such that the force exerted by it on the mask is through the mask substantially along a diagonal thereof so as to preclude the imposition of any substantial movement on the mask, said leaf spring having a relatively low spring rate, i.e., in flexure out of its plane, yet being very stiff in its own plane such that said three devices acting in concert precisely fix and hold a mask in a predetermined spatial position relative to the faceplate against translational or rotational displacement, in spite of any thermal expansion or contraction of the mask, demounting and remounting of the mask, or mechanical shocks, and do so without distorting or deforming the mask.

2. The system defined by claim 1 wherein said spring constitutes a part of said mask-mounted component, and wherein said provision thereon is an aperture for receiving a mating lug on said envelope-associated component.

3. The system defined by claim 1 wherein said spring constitutes a part of said envelope-associated component, and wherein said provision thereon is an integral lug for engaging a mating aperture in said mask-mounted component.

4. The system defined by claim 1 wherein said mask-mounted component comprises a unitary sheet metal bracket-spring member having a support portion attached to said mask and having on a distal end thereof said leaf spring.

5. The system defined by claim 1 wherein said mask-mounted component includes discrete bracket means mounted on said mask, said leaf spring being affixed to said bracket means.

6. The system defined by claim 1 wherein said envelope-associated component is a stamped metal mask support stud embedded in the faceplate portion of the tube and having an integral lug therein, and said aperture on said spring engageably receiving said lug on said stud.

7. The system defined by claim 1 wherein the ratio of the width $w$ to the thickness $t$ of said leaf spring is between about 25 and 300, and the effective length thereof is between about $0.5w$ and $1.5w$.

8. The system defined by claim 1 wherein said leaf spring contitutes part of said envelope-associated component and is supported to extend away from the faceplate.

9. The system defined by claim 1 wherein said leaf spring constitutes part of said mask-mounted component and is supported to extend toward the faceplate.

10. The system defined by claim 1 wherein said leaf spring constitutes part of said mask-mounted component and is supported to extend away from the faceplate.

11. The system defined by claim 1 wherein said leaf spring constitutes part of said envelope-associated component and is supported to extend toward the faceplate.

12. For use in a color cathode ray tube having an envelope which includes a rectangular, curved, flangeless faceplate supporting on a concave inner surface thereof, in a central region, a phosphor screen comprising a pattern of red-emissive, blue-emissive and green-emissive phosphor triads, the combination comprising:

a rectangular, non-self-rigid shadow mask having a central portion with curvature related to that of the faceplace and containing a pattern of electron-transmissive apertures registered with said patterns of phosphor triads, said shadow mask also having an integral stiffening portion circumscribing said central portion causing said mask to be relatively stiff with respect to its major and minor axes, yet relatively flexible in torsion about its diagonals, said stiffening portion including a radially outwardly extending, electron-shielding skirt; and a mask suspension system for detachably supporting said shadow mask at a predetermined spacing from said inner, i.e., screen bearing surface of said faceplate, comprising four suspension devices, one at each corner of the mask, for detachably coupling said mask to said faceplate, at least three of said suspension devices each including an envelope-mounted component affixed to said screen-bearing surface of said faceplate on a diagonal of said faceplate, and a mask-mounted component secured to the outside of said stiffening portion of said mask, one of said mask-mounted and envelope-mounted components including an axially extending, non-folded leaf spring which is cantilevered such that it deflects with an arc of motion in a plane perpendicular to the mask and which has at its distal end provision for detachably engaging a mating provision on the other of said components, said leaf spring being arranged such that the force exerted by it on the mask is through the mask substantially along a diagonal thereof so as to preclude the imposition of any substantial moment on the mask, said leaf spring having a relatively low spring rate, i.e., in flexure out of its plane, so as to desensitize the suspension system to tolerance-related configurational and positional errors therein and so as to impart on the mask, for a given spring deflection, a relatively low load, yet said spring being very stiff in its own plane such that said three devices acting in concert precisely fix and hold a mask in a predetermined spatial position relative to the faceplate against translational or rotational displacement, in spite of any thermal expansion or contraction of the mask, demounting and remounting of the mask, or mechanical shocks and do so without distorting or deforming the mask.

13. The system defined by claim 12 wherein said leaf spring constitutes part of said mask-mounted component and is supported to extend toward the faceplate.

14. The system defined by claim 12 wherein said leaf spring constitutes part of said mask-mounted component and is supported to extend away from the faceplate.

15. The system defined by claim 12 wherein said leaf spring constitutes part of said envelope-associated component and is supported to extend toward the faceplate.

16. The system defined by claim 12 wherein said leaf spring constitutes part of said envelope-associated component and is supported to extend away from the faceplate.

17. The apparatus defined by claim 12 wherein said mask-mounted component includes a bracket secured to said stiffening portion of said mask so as to extend around a corner on the outside thereof, said leaf spring being attached at one end to said bracket so as to extend toward said screen and having at its distal end said provision for detachably engaging said envelope-associated component.

18. The apparatus defined by claim 17 wherein said envelope-associated component comprises a metal stud affixed to said faceplate and having a radially inwardly extending lug located on said diagonal, and wherein said provision on said leaf spring comprises an aperture for a retentively receiving said lug on said stud.

19. The apparatus defined by claim 18 wherein said spring has a width which is approximately 0.5 to 1.5 times its effective length.

20. The apparatus defined by claim 19 wherein the loading imposed on said mask by said spring is between about 0.43 lbs. and 2.4 lbs. for a spring deflection of between about 50–270 mils.

21. The apparatus defined by claim 12 wherein three of said suspension devices fix in the plane of the mask the spatial position of the mask relative to the inner surface of the faceplate and a redundant fourth suspension device has provision for permitting the fourth corner of the mask to seek an equilibrium position in said plane of the mask.

* * * * *

PO-1050
(5/69)

UNITED STATES PATENT OFFICE

CERTIFICATE OF CORRECTION

Patent No. 3,986,072 Dated October 12, 1976

Inventor(s) Alfred Adamski

It is certified that error appears in the above-identified patent and that said Letters Patent are hereby corrected as shown below:

In column 1, line 39, "suport" should be "support--;

In column 7, lines 32-39 should not have been set in boldface type;

In column 9, line 5, "respectiely" should be --respectively--;

In column 9, line 67, "the" (second instance) should be --The--;

In column 11, line 42, "flxibility" should be --flexibility--;

In column 12, line 63,"by" should be --be--;

In column 12, last line "Q" should be in quotation marks ; and

In column 16, line 46,"Q" should be in quotation marks.

Signed and Sealed this

First Day of March 1977

[SEAL]

*Attest:*

RUTH C. MASON
*Attesting Officer*

C. MARSHALL DANN
*Commissioner of Patents and Trademarks*